US005725207A

United States Patent [19]

Deguchi

[11] Patent Number: 5,725,207

[45] Date of Patent: Mar. 10, 1998

[54] SHEET FEEDING/DISCHARGING DEVICE DESIGNED FOR IMAGE FORMING APPARATUS

[75] Inventor: Masanobu Deguchi, Kashiba, Japan

[73] Assignee: Sharp Kabushiki Kaisha, Osaka, Japan

[21] Appl. No.: 458,876

[22] Filed: Jun. 2, 1995

[30] Foreign Application Priority Data

Jul. 28, 1984 [JP] Japan ..... 6-177287

[51] Int. Cl.[6] ..... B65H 5/00

[52] U.S. Cl. ..... 271/9.09; 271/65; 271/902; 271/186; 271/225; 271/213

[58] Field of Search ..... 271/65, 902, 186, 271/184, 185, 9.09, 225, 213, 209

[56] References Cited

U.S. PATENT DOCUMENTS

| | | | |
|---|---|---|---|
| 4,740,817 | 4/1988 | Suzuki et al. | 271/9.09 |
| 4,754,293 | 6/1988 | Aizawa et al. | 271/186 |
| 5,052,678 | 10/1991 | Looney | 271/186 |
| 5,069,435 | 12/1991 | Mizutami | 271/9.09 |
| 5,111,252 | 5/1992 | Hamada et al. | 271/213 |
| 5,222,722 | 6/1993 | Kamano | 271/9.09 |

FOREIGN PATENT DOCUMENTS

| | | |
|---|---|---|
| 62-31344 | 7/1987 | Japan . |
| 3156473 | 7/1991 | Japan . |

*Primary Examiner*—William E. Terrell
*Assistant Examiner*—Khoi H. Tran

[57] ABSTRACT

A feeding/discharging device designed for an image forming apparatus includes an inner tray and an outer tray which also serves as a feed tray, for receiving sheets discharged from the image forming apparatus. In the main body of the image forming apparatus, a transportation system is formed above a feed cassette, and an inner tray is provided in a sheet discharge section formed above the transportation system. The outer tray is mounted to an external section of the main body so as to be freely rotatable. The outer tray is formed at a different level from the inner tray, and there is a gap defined betwen the inner tray and the outer tray. The outer tray is positioned below the inner tray, and in such a manner that the outer tray is positioned below the inner tray at the gap between the inner tray and the outer tray, thereby forming an opening in the gap, which leads to a transportation roller of the transportation system. In the both-sided copy mode, sheets placed over the inner tray and the outer tray are displaced in a sheet discharge direction so as to be inserted into the opening for feeding the sheets. The described sheet feeding/discharging device offers an easy handling of sheets. Moreover, the sheets supplied from the feed cassette and the outer tray can be transported through the common transportation system. Further, by forming the transportation system and the inner tray above the feed cassette, the entire apparatus can be miniaturized.

24 Claims, 8 Drawing Sheets

SHEET FEEDING/DISCHARGING DEVICE DESIGNED FOR IMAGE FORMING APPARATUS

FIELD OF THE INVENTION

The present invention relates to a sheet feeding/discharging device designed for an image forming apparatus such as a copying machine, a printer, etc., for feeding sheets for forming thereon images and discharging the sheets having images formed thereon.

BACKGROUND OF THE INVENTION

In general, an image forming apparatus such as a copying machine, etc., includes a feeding device for guiding sheets for forming images thereon to a processing section formed in the inside of a main body of the apparatus, and a discharging device for discharging sheets having images formed thereon by the processing section in the outside of the main body. The image forming apparatus which permits a manual feeding also includes a manual feed tray formed as a part of the sheet feeding device. In the described generally used image forming apparatus, a discharge tray for receiving thereon discharged sheets is formed as a part of the discharging device.

For example, as shown in FIG. 9, Japanese Examined Patent Publication No. 31344/1987 (Tokukosho 62-31344) discloses a copying machine provided with a discharge tray 101 mounted to the outer wall of a main body 102. The discharge tray 101 includes a manual feed tray 101*a* at a lower level. The copying machine of this publication is arranged such that sheets fetched from feed cassettes 103 and 104 are discharged onto the discharge tray 101 by a discharge roller 106 after applying thereto image forming processes in a copy processing section 105.

In the both-sided copy mode, sheets having images formed on one side thereof are once guided to the manual feed tray 101*a* by a transporting direction switching member 107 and a roller 108, and thereafter, the sheets are dropped to a buffer tray 109 by their dead weight to be stored therein. Then, the sheets are transported in the reversed direction to the copy processing section 105, thereby permitting a both-sided copying operation.

In the described copying machine, when performing a both-sided copy operation, by utilizing the manual feed tray 101*a* as a space for reversing the direction of sheets, it is not required to form such space also in the inside of the main body 102, thereby permitting the main body 102 to be miniaturized.

As described, the described copying machine permits the main body 102 of a reduced size. However, the transporting direction switching member 107 and the roller 108, etc., are additionally required for the both-sided copy operation, thereby presenting the problem of increasing the cost compared with copying apparatus which are not provided with the both-sided copy function. For this reason, although some high grade copying apparatuses provided with many functions permit the both-sided copy operation, it is difficult to apply the both-sided copy function to generally used copying machines at a reasonable price.

Here, a both-sided copy operation in the copying machine which does not have the both-sided copy function will be explained. When performing the both-sided copy operation in such copying machine, a sheet discharged onto the discharge tray 101 is set in the manual feed tray 101*a* by the user, and the sheet is transported to the copy processing section 105, thereby performing both-sided copy operation.

However, in the described copying machine, an opening section for feeding sheets of the manual feed tray 101*a* is formed at the same position as one end portion of the discharge tray 101. Therefore, when performing the both-sided copy operation, the sheet can be set in the manual feed tray 101 only after the sheet is completely taken out of the discharge tray 101. Here, as an opening for feeding sheets is small, careful caution is needed when inserting the sheet.

Because of the structures of the trays 101 and 101*a*, it is troublesome to handle the sheets in the described simple both-sided copy operation using the discharge tray 101 and the manual tray 101*a*.

In the conventional copying machines, the sheet transport path transports the sheet almost in one direction from the feed cassettes 103 and 104 to the discharge tray 101. Therefore, the copying machine requires the length in the sheet transporting direction to be at least twice as long as the length of the feed cassettes 103 and 104. Therefore, in such a copying machine, it is difficult to achieve the main body 102 of a still reduced size.

SUMMARY OF THE INVENTION

An object of the present invention is to provide an image forming apparatus which offers an easy handling of a sheet in a both-sided copy mode and which enables a main body of the apparatus to be miniaturized by improving a sheet transportation path that is applicable to a both-sided copy operation.

In order to achieve the above object, the first sheet feeding/discharging device designed for an image forming apparatus in accordance with the present invention is arranged so as to include:

- a first tray for receiving sheets discharged from the image forming apparatus; and
- a second tray for receiving the sheets discharged from the image forming apparatus, the second tray being projected in a sheet discharge direction to a greater extent than the first tray, the second tray being formed at a different level from the first tray,
- wherein an opening for feeding sheets in a main body of the image forming apparatus is formed as the second tray is positioned at a lower level than the first tray in a gap formed between the first tray and the second tray.

In the first sheet feeding/discharging device, the sheet having formed thereon an image is discharged onto first tray. Here, since the end portion on the sheet discharge side of the second tray is projected in the sheet discharge direction than the first tray, the sheet is placed over the first tray and the second tray if the sheet size is large. Further, the second tray is formed at a different level from the first tray, and in a gap formed between the first tray and the second tray, the opening for feeding sheets is formed as the second tray is positioned at a lower level than the first tray. Therefore, the sheet can be fed by the second tray.

With the described arrangement, by displacing the rear end of the sheet discharged over the first tray and the second tray in the sheet discharge direction to be dropped onto the second tray, and inserting the sheet into the opening for feeding sheets, the device can be easily switched from the sheet discharge position to the sheet feed position. Therefore, in the both-sided copy operation, the process for feeding the sheet having an image formed on one surface thereof again to the image forming apparatus can be easily performed.

In the first feeding/discharging device, it is preferable that the second tray is formed in the sheet discharge section which is opened to the outside of the main body of the image forming apparatus, and that the second tray is mounted to the main body so as to open and close the sheet discharge section. In this way, a the space for discharging the sheet is formed both in the inside and the outside of the main body of the image forming apparatus. As a result, the problem associated with the conventional general image forming apparatuses that the space for discharging the sheet is projected to the outside of the main body to a great degree can be prevented. Furthermore, since the second tray is mounted to the main body of the image forming apparatus so as to open and close the sheet discharge section, by closing the sheet discharge section when the second tray is not used, the sheet discharge section can be prevented from having foreign substances entered thereto, and the second tray will not occupy the space uselessly.

In order to achieve the above object, the second sheet feeding/discharging device designed for an image forming apparatus is arranged so as to include:

a first tray for receiving sheets discharged from the image forming apparatus; and a second tray for receiving sheets to be fed to the image forming apparatus, the second tray being projected in a sheet discharge direction to a greater extent than the first tray, the second tray being positioned at a lower level than the first tray, wherein an opening for feeding sheets in a main body of the image forming apparatus is formed between the first tray and the second tray.

According to the second sheet feeding/discharging device, the sheets having formed thereon an image is discharged from the image forming apparatus onto the first tray. Here, since the rear end portion in the sheet discharge direction of the second tray is projected in the sheet discharge direction to a greater extent than the first tray, by displacing the rear end portion of the sheet discharged onto the first tray in the sheet discharge direction so as to be dropped to the projected portion of the second tray, and inserting the sheet into the opening for feeding sheets, the apparatus can be easily switched from the sheet discharge state to the sheet feed state. Therefore, in the both-sided copy operation, the process for feeding the sheet having an image formed on one surface thereof again to the image forming apparatus can be simplified. Moreover, since the first tray receives the discharged sheet, while the second tray stores the fed sheet, the sheet discharged on the first tray will not be placed over the second tray, thereby enabling the sheet discharge operation and the sheet feeding operation to be performed independently.

In the second feeding/discharging device, it is preferable that the inner portion of the first tray is provided in the sheet discharge section which is opened to the outside of the main body of the image forming apparatus, and the sheet discharge section is opened and closed by not only the outer portion mounted to the inner portion so as to be freely rotatable but also by the second tray. In this arrangement, the sheet discharge section can be prevented from having foreign substances entered thereto, and the image forming apparatus can be miniaturized. Moreover, since the outer portion of the first tray and the second tray rotate independently, the device can be used in the state where the outer portion of the first tray is closed and the second tray is opened. According to the described arrangement, when copying on a sheet of a small size, the sheet can be inserted into the opening for feeding sheets without being interfered by the outer portion.

In order to achieve the above object, the third sheet feeding/discharging device designed for an image forming apparatus of the present invention is arranged so as to include:

sheet storage means formed in an inside of a main body of the image forming apparatus, for feeding sheets for an image forming operation;

first reversal means for reversing a transporting direction of a sheet fetched from one end side of the sheet storage means;

transportation means for transporting the sheet in a reversed transporting direction by the first reversal means to an other end side of the sheet storage means;

second reversal means for reversing the transporting direction of the sheet transported by the transportation means;

a first tray for receiving the sheet transported in the reversed transporting direction by the second reversal means, the first tray being positioned above the transportation means; and a second tray for guiding the sheet to one end portion of the transportation means on a first reversal means side, the second tray being positioned at a lower level than the first tray.

According to the third sheet feeding/discharging device, when the sheet stored in the sheet storage means is fetched from one end portion of the sheet storage means, the transporting direction is reversed by the first reversal means. The sheet that is transported to the other end side of the sheet storage means by the transportation means is received by the first tray after the sheet transportation direction is reversed by the second reversal means. On the other hand, the sheet received by the second tray is guided to one end portion of the transportation means on the side of the first reversal means. Then, after the sheet transporting direction is reversed by the second reversal means, the sheet is received by the first tray.

As described, the third sheet feeding/discharging device is arranged such that the second tray guides the sheet to the transportation means at the end portion of the transportation means on the first reversal means side. Therefore, when feeding sheets by the sheet storage means and the second tray, the transportation means and the second reversal means are used in common.

Further, it is preferable that the third sheet feeding/discharging device is arranged such that the inner portion of the first tray is formed in the discharge section which is mounted to the main body of the image forming apparatus so as to be opened to the outside, and the sheet discharge section is opened and closed not only by the outer portion mounted to the inner portion so as to be freely rotatable but also by the second tray. In this arrangement, the sheet discharge section can be prevented from having foreign substances entered thereto, and the image forming apparatus can be miniaturized. Moreover, since the outer portion and the second tray rotate independently, when copying the sheet of a small size, the sheet can be inserted into the opening for feeding sheets without being interfered by the outer portion of the first tray.

In order to achieve the above object, the fourth sheet feeding/discharging device designed for an image forming apparatus is arranged so as to include:

sheet storage means formed in an inside of a main body of the image forming apparatus, for feeding sheets for an image forming operation;

first reversal means for reversing a transporting direction of a sheet fetched from one end side of the sheet storage means;

transportation means for transporting the sheet in a reversed transporting direction by the first reversal means to an other end side of the sheet storage means;

second reversal means for reversing the transporting direction of the sheet transported by the transportation means;

a first tray for receiving the sheet transported in the reversed transporting direction by the second reversal means, the first tray being positioned above the transportation means; and a second tray for receiving the sheet discharged from the image forming apparatus, the second tray being projected in the sheet discharge direction to a greater extent than the first tray, the second tray being formed at a different level from the first tray, wherein an opening for feeding sheets in a main body of the image forming apparatus is formed as the second tray is positioned at a lower level than the first tray in a gap formed between the first tray and the second tray, and the opening leads to one end portion of the transportation means on a first reversal means side.

According to the fourth sheet feeding/discharging device, a sheet is transported from the sheet storage means to the first tray by the first reversal means, the transportation means and the second reversal means as in the case of the third sheet feeding/discharging device. Here, since the end portion in the sheet discharge direction of the second tray is projected in the sheet discharge direction to a greater extent than the first tray, the sheet transported to the first tray is placed also over the second tray.

Moreover, since the second tray is formed at a different level from the first tray, in the gap formed between the first tray and the second tray, an opening for feeding sheets is formed as the second tray is positioned at a lower level than the first tray, thereby enabling the sheet to be fed from the second tray. According to the described arrangement, by displacing the rear end portion of the sheet discharged over the first tray and the second tray in the sheet discharge direction so that the front end portion of the discharged sheet is dropped onto the second tray and inserting the sheet into the opening for feeding sheets, the device can be easily switched from the sheet discharge state to the sheet feed state. Therefore, in the both-sided copy operation, the process for feeding the sheet having an image formed on one surface thereof again to the image forming apparatus can be easily performed.

The sheets received by the second tray are guided to one end portion of the transportation means on a first reversal means side to be transported to the first tray by the transportation means and the second reversal means. As described, since the opening for feeding sheets leads to the end portion of the transportation means on the first reversal means side, when feeding sheets from the sheet storage means and from the second tray, the transportation means and the second reversal means can be used in common.

In order to achieve the above object, the fifth sheet feeding/discharging device designed for an image forming apparatus, is arranged so as to include:

sheet storage means formed in an inside of a main body of the image forming apparatus, for feeding sheets for an image forming operation, first reversal means for reversing a transporting direction of a sheet fetched from one end side of the sheet storage means;

transportation means for transporting the sheets in a reversed transporting direction by the first reversal means to an other end side of the sheet storage means, the transportation means leading to an outside of the main body of the image forming apparatus at one end portion on a first reversal means side;

second reversal means for reversing the transporting direction of the sheet transported by the transportation means; and a tray for receiving sheets transported in the reversed transporting direction by the second reversal means, the tray being formed above the transportation means.

In the arrangement of the fifth sheet feeding/discharging device, sheets are transported from the sheet storage means to the tray by the first reversal means, the transportation means and the second reversal means as in the case of the third sheet feeding/discharging device. The transportation means leads to the outside of the main body of the image forming apparatus at the end portion on the first reversal means side. Therefore, the sheets can be fed from the outside of the main body of the image forming apparatus using the transportation means. Therefore, when feeding sheets from the sheet storage means and from the outside, the transportation means and the second reversal means can be used in common.

The transportation means is formed above the sheet storage means, and the tray is formed above the transportation means. Therefore, the transportation means and the tray are formed on the sheet storage means. The described arrangement offers a small bottom area of the image forming apparatus compared with the arrangement where the sheet storage means, the transportation means and the tray are placed two-dimensionally.

For a fuller understanding of the nature and advantages of the invention, reference should be made to the ensuing detailed description taken in conjunction with the accompanying drawings.

BRIEF DESCRIPTION OF THE DRAWINGS

FIG. 6(*b*) is a perspective view showing the state where the sheet is discharged over an inner tray and an outer tray.

FIG. 6(*c*) is a perspective view showing the state where the sheet has being moved onto the outer tray for copying on both sides of the sheet.

FIG. 6(*d*) is a perspective view showing the state where the sheet is inserted in the inside of the copying machine from the outer tray.

FIG. 6(*e*) is a perspective view showing the state of the sheet discharged on the inner tray after having images on both surfaces thereof.

DESCRIPTION OF THE EMBODIMENTS

[Embodiment 1]

The following descriptions will discuss one embodiment of the present invention in reference to FIG. 1 through FIG. 6.

Figure 1:
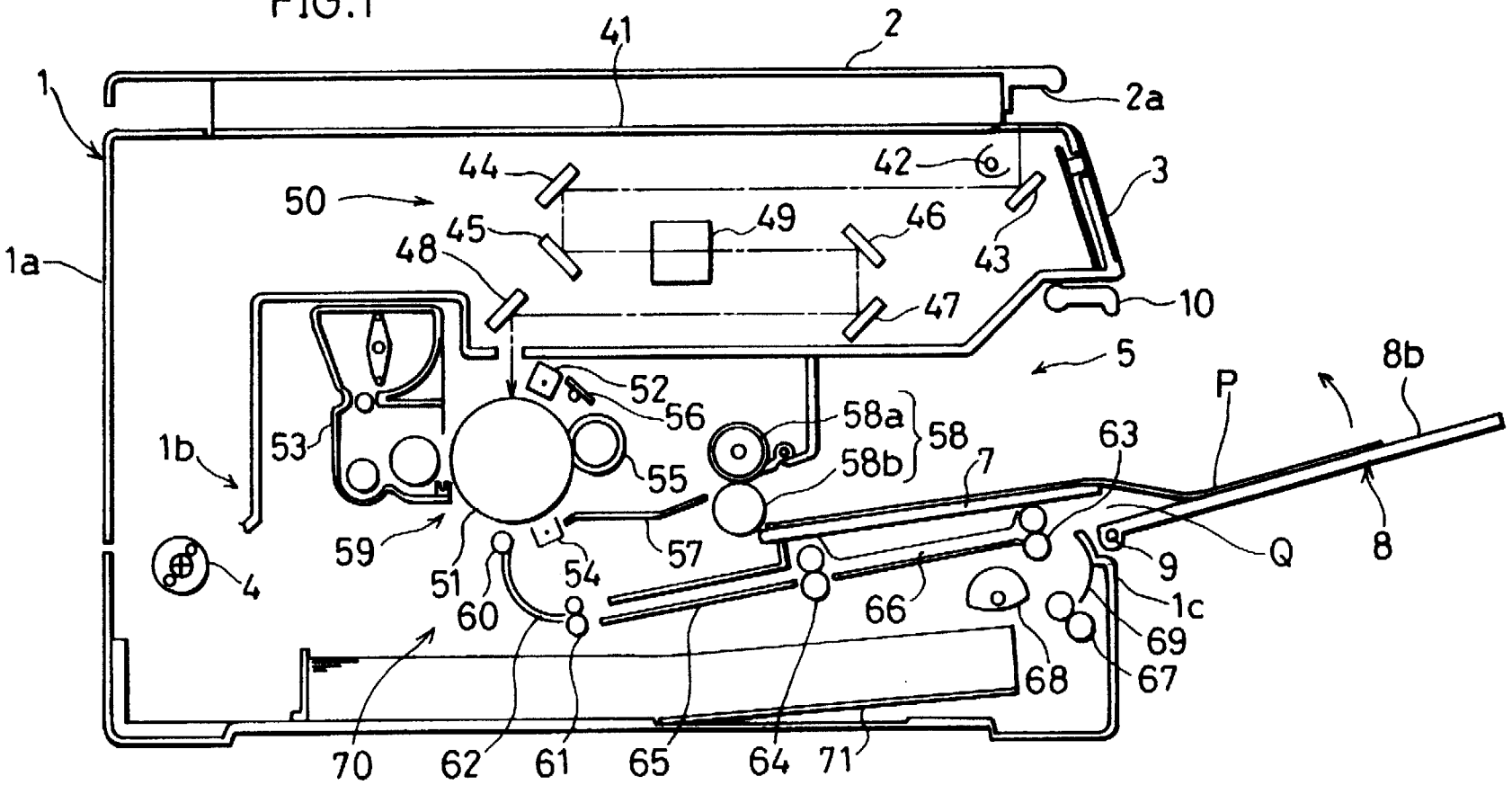
FIG. 1 is a longitudinal sectional view showing a schematic configuration of a copying machine in accordance with the first embodiment of the present invention.
Figure 2:
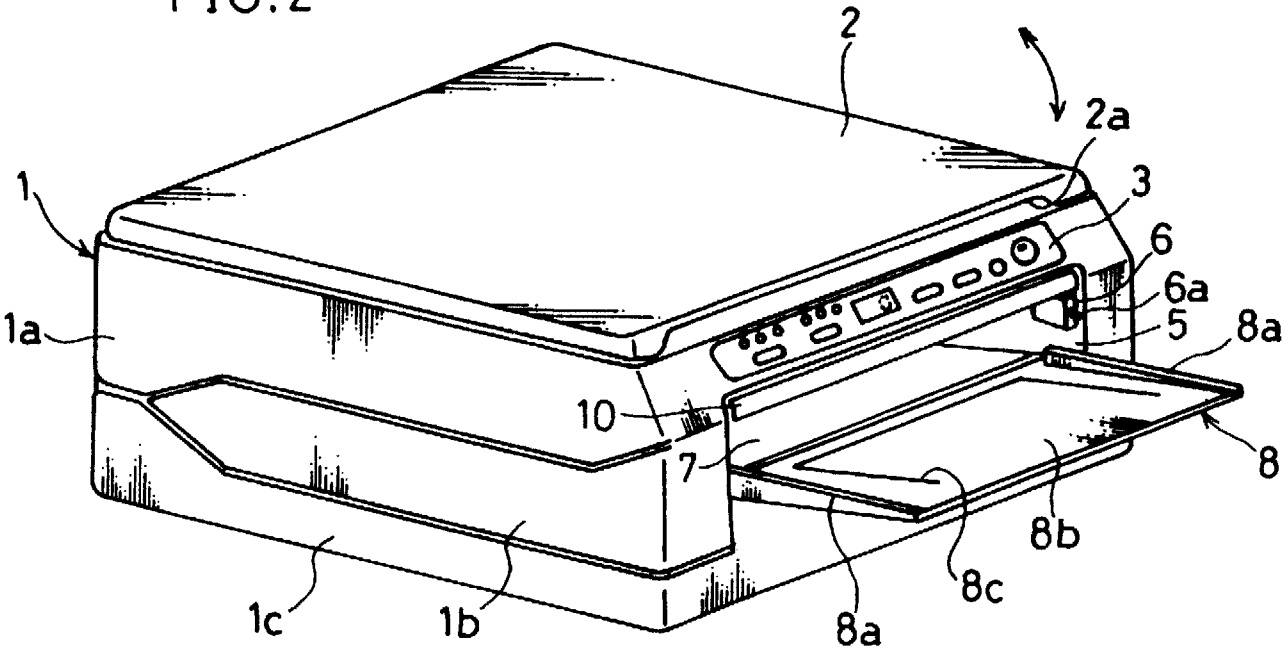
FIG. 2 is a perspective view showing an outside view of the copying machine of FIG. 1.

As shown in FIG. 2, a copying machine in accordance with the present embodiment includes a main body 1. On the main body 1, a document cover 2 which covers a document platen 41 (to be described later) is formed so as to be freely opened and closed in directions shown by arrows. The document cover 2 includes a grip 2*a* at the corner on the opening and closing side for allowing the user to hold the document cover 2 to move it up and down. The main body 1 is composed of an upper unit 1*a*, an intermediate unit 1*b* and a lower unit 1*c* which are detachable. In the main body 1, the three units 1*a*–1*c* are connected by a torsion bar 4 shown in FIG. 1 so as to be freely opened and closed independently at the same as the side where the document cover 2 is supported so as to be freely opened and closed.

Figure 3:
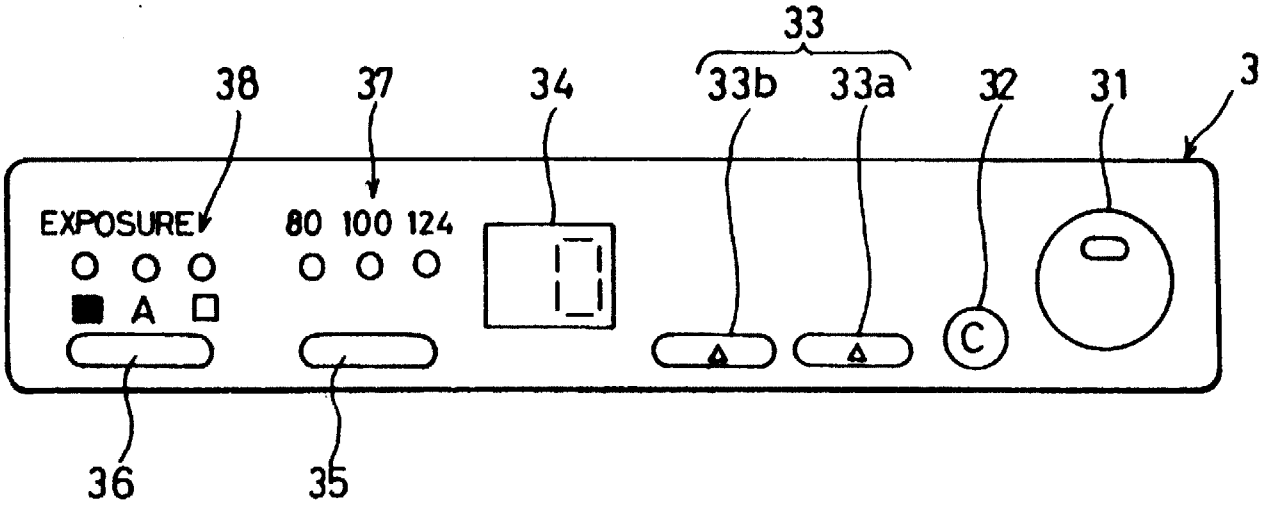
FIG. 3 is a front view showing a configuration of an operation panel of the copying machine of FIG. 1.

An operation panel 3 is formed on the outer surface of the upper unit 1*a* at a position right under the grip 2*a*. As shown in FIG. 3, the operation panel 3 includes a start button 31, a clear key 32, a number of copies setting key 33, a display section 34, a magnification setting key 35 and an exposure setting key 36.

The start button 31 is an operation button for initiating a copy operation. The clear key 32 is an operation key for cancelling each function set by the number of copies setting key 33, the magnification setting key 35 or the exposure setting key 36.

The number of copies setting key 33 is an operation key for setting the number of copies to be produced. The number of copies setting key 33 includes a first key 33*a* for setting a number in the first digit, and a second key 33*b* for setting a number in the second digit. It is arranged such that by pressing the first key 33*a* or the second key 33*b* once, the number in the corresponding digit to be displayed in the display section 34 increases by one.

The magnification setting key 35 is an operation key for setting the magnification of copies to be produced. Every time the magnification setting key 35 is pressed, the magnification is switched to 100%, 80% and 124% in this order. Then, by a flash of a display LED 37 formed on the magnification setting key 35, the switched magnification is shown.

The exposure setting key 36 is an operation key for setting the exposure in forming images. Every time the exposure setting key 36 is pressed, the exposure level is switched from "standard" (A), "bright" (□) and "dark" (■) in this order. Then, by flashing a display LED 38 formed on the exposure setting key 36, the switched level of the exposure is shown.

The sheet discharge section 5 formed in the inside of the main body 1 is opened to the outside right below the operation panel 3. In the sheet discharge section 5, a power switch 6 is formed on the side face, while an inner tray 7 (first tray) is formed at the bottom. At the bottom end portion of the opening of the sheet discharge section 5, as shown in FIG. 1, an outer tray 8 is connected to the lower unit 1*c* so as to be freely rotatable by the shaft 9, so that the sheet discharge section 5 can be opened and closed as desired. At the upper end portion of the opening of the sheet discharge section 5, a grip 10 is attached to the upper unit 1*a* so as to be freely rotatable. The grip 10 allows the user to open and close the upper unit 1*a* by griping the grip 10.

Figure 4:
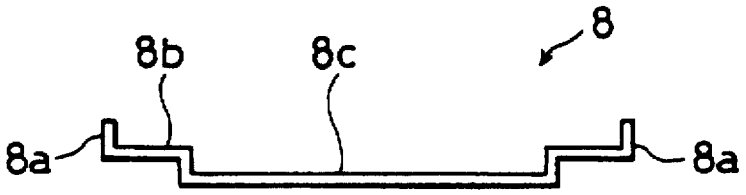
FIG. 4 is a sectional view showing a shape of a sheet guide provided on an outer tray in the copying machine of FIG. 1.

The outer tray 8 includes ribs 8*a* on both sides, and as shown in FIG. 4, a sheet guide 8*c* is formed as a regulating section on a sheet placement surface 8*b* for placing thereon sheets. The sheet guide 8*c* which is concave is provided for regulating the position of the sheets in a widthwise direction. The width of the sheet guide 8*c* may be set, for example, to 8.5 inch for U.S. standard, or A4 size for European standard. Although not shown, the sheet guide 8*c* may be formed so as to have plural levels of concaves to be adjusted to the sheets of various sizes.

Figure 5:
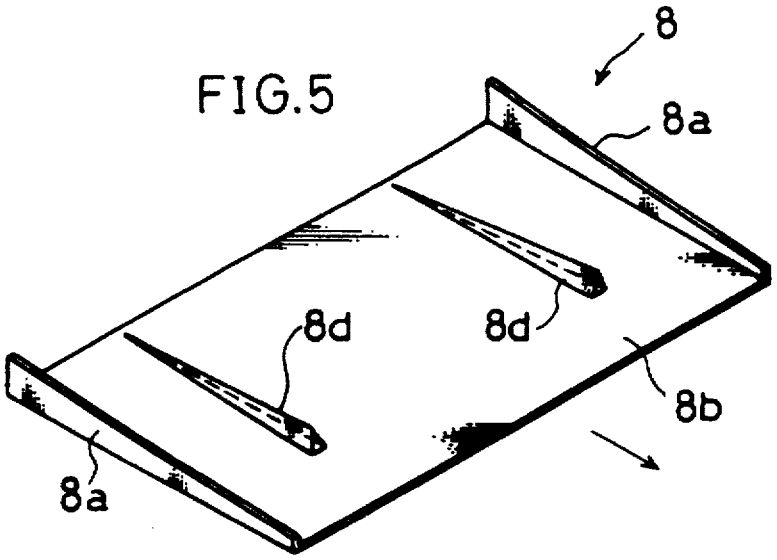
FIG. 5 is a perspective view showing a shape of a guide rib provided in an outer tray in the copying machine of FIG. 1.
Figure 6A:
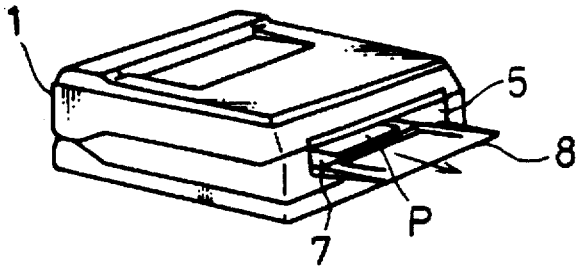
FIG. 6(*a*) is a perspective view showing a state of discharging a sheet in the copying machine of FIG. 1.
Figure 6B:
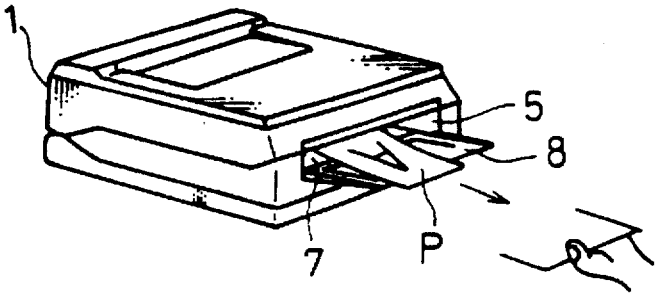
Figure 6C:
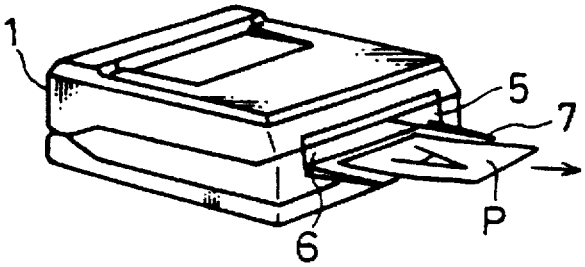
Figure 6D:
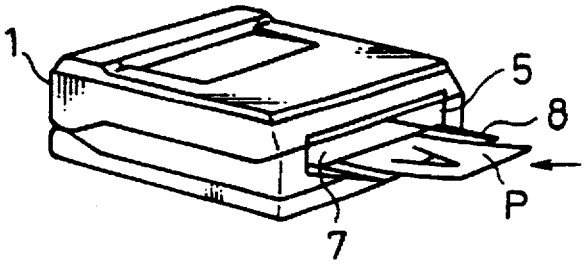
Figure 6E:
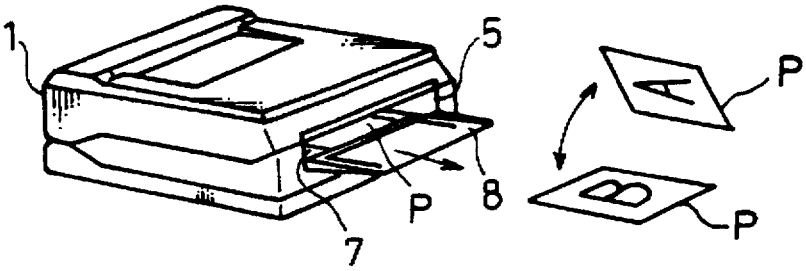

For the regulating section, in replace of the recessed sheet guide 8*c*, as shown in FIG. 5, guide ribs 8*d* which are vertically formed on the sheet placement surface 8*b* may be adopted. The guide ribs 8*d* are formed in such a manner that the respective heights thereof become gradually higher from the side of the main body 1 in the sheet discharging direction (in a direction of an arrow). The guide ribs 8*d* are formed in the described manner for preventing the sheets from being caught by the respective ends portions of the guide ribs 8*d* when moving the sheets from the inner tray 7 to the outer tray 8 in a manner to be described later. The interval between the guide ribs 8*d* is formed to be reduced gradually from the upper ends to the bottom ends.

The power switch 6 is provided for switching the power supply ON/OFF of the copying machine. The power switch 6 turns the power supply OFF when the outer tray 8 closes the sheet discharge section 5 and the rib 8*a* presses a knob 6*a*, while it turns the power supply ON when the outer tray 8 is opened, and the rib 8*a* is separated from the knob 6*a*.

As shown in FIG. 1, the copying machine includes a document platen 41 made of a transparent glass formed on an upper portion of the upper unit 1*a*. In the inside of the upper unit 1*a*, an optical system 50 composed of a light source 42, mirrors 43 through 48 and a lens 49 is formed under the document platen 41. The optical system 50 is provided for projecting light emitted from the light source 42 onto a document for performing an optical scanning operation. The optical system 50 also guides light reflected from the document to a photoreceptor drum 51 provided in a position below the optical system 50.

Around the circumference of the photoreceptor drum 51, a main charger 52, a developer unit 53, a transfer charger 54, a cleaning unit 55 and an eraser 56, etc., are provided. A guide plate 57 is formed for guiding the sheet in the sheet discharge direction from a vicinity of the discharge side of the transfer charger 54. Around the end portion of this guide plate 57, a fusing section 58 composed of an upper roller 58*a* and a lower roller 58*b* is formed. On the discharge side of the fusing section 58, the described sheet discharging section 5 is formed.

In the copying machine of the present embodiment, a copy processing section 59 composed of the photoreceptor drum 51, the main charger 52, the developing unit 53, the transfer charger 54, the cleaning unit 55, the eraser 56, the fusing section 58, etc. is adopted. The copy processing section 59 develops an electrostatic latent image formed on the photoreceptor drum 51 using light emitted from the optical system 50 as a toner image, and the toner image is copied onto the sheet. The copy processing section 59 transports the copied sheet to the fusing section 58, where the toner image formed on the sheet is made permanent by applying thereto heat and pressure.

In the copy processing section 59, the main charger 52, the cleaning unit 55, the eraser 56 and the upper roller 58*a* of the fusing section 58 are formed in the upper unit 1*a*. The photoreceptor drum 51, the developer unit 53, the transfer charger 54 and the lower roller 58*b* are formed in the intermediate unit 1*b*.

In a vicinity of the sheet feed side of the transfer charger 54, a register roller 60 is formed for synchronizing the sheet with the movement of the light source 42 for optical scanning. Below the transfer charger 54, a transport roller 61 is provided. A transport guide 62 (second reversal means) is formed in a bent shape between the register roller 60 and the transport roller 61.

A transport roller 63 is provided in a vicinity of the shaft 9. At a substantial center between the transport roller 61 and the transport roller 63, a transport roller 64 is formed. Further, flat transport guides 65 and 66 are respectively formed between the transport roller 61 and the transport roller 64, and between the transport roller 63 and the transport roller 64. Below the transport roller 63, the transport roller 67 and the feed roller 68 are formed. Between the transport roller 67 and the transport roller 63, a transport guide 69 which serves as the first reversal means is formed in a bent shape.

The described transport rollers 61, 63 and 64, and the transport guides 62, 65, 66 and 69 constitute a transportation system 70. The transportation system 70 is formed in the intermediate unit 1*b*. The transportation system 70 is formed in an S-shape so as to convey sheets from a feed cassette 71 (to be described later) to the copy processing section 59.

The sheet transportation path composed of the transport guides 65 and 66 is sloped downward from the side of the transport roller 63 towards the transport roller 61. The described transport rollers 61, 63 and 64 and the transport guides 65 and 66 constitute the transportation means.

The feed cassette 71, which serves as sheet storage means for storing plural sheets, is formed in the lower unit 1*c*. The feed cassette 71 is provided almost within a space between the developer unit 53 and the feed roller 68.

In the sheet discharge section 5 formed above the transport rollers 63 and 64 and the transport guide 65, the inner tray 7 is formed. The inner tray 7 is formed to the length from a vicinity of the lower roller 58*b* to the opening of the sheet discharge section 5. The inner tray 7 is fixed at an inclined position nearly along the transport guide 66. In order to ensure a space between the end portion thereof in the sheet discharge direction (shaft 9 side) and the shaft 9, the inner tray 7 is formed at a different level from the outer tray 8. With this arrangement, an opening Q for feeding sheets, which leads to the transport roller 63, is formed. The rotatable range of the outer tray 8 is regulated such that in its open position, the sheet placement surface 8*b* is sloped upward at a slightly larger angle than the transport guides 65 and 66.

The length of the inner tray 7 in the sheet discharge direction is set between the length of around one-half (150 mm) of the sheet of the maximum size used in the copying machine (A4-size) and the length (around 100 mm) which allows the user's hand to hold the end portion of the sheet of the minimum size (post card size) to be protruded from the inner tray 7. On the other hand, the sum of the lengths in the sheet discharge direction of the outer tray 8 and the inner tray 7 is set to around 300 mm so that the sheet of the maximum size (A4-size) can be placed over the inner tray 7 and the outer tray 8.

As described, in the copying machine, the sheet P fetched from the feed cassette 71 by the feed roller 68 is transported through the transportation system 70 to be supplied to the photoreceptor drum 51 by the register roller 60. After the toner image formed on the photoreceptor drum 51 is copied to the sheet by the transfer charger 54, a further fixing process of the toner image is performed by the fusing section 58. As described, the sheet P having an image formed thereon is placed on the inner tray 7. Here, the sheet P of a large size such as A-4 size is placed over the inner tray 7 and the outer tray 8.

In the case of feeding a sheet using the outer tray 8, the sheet P placed on the outer tray 8 is pushed into the main body 1. Then, the sheet is fed into the main body 1 by the transport roller 63 to be transported the copy processing section 59 by the transport rollers 64 and 61.

In the both-sided copy mode, as shown in FIG. 6(*a*), the sheet P whereon "A" is copied is discharged to the inner tray 7. Then, as shown in FIG. 6(*b*), the sheet P is placed over the inner tray 7 and the outer tray 8, thereby completing the discharge of the sheet P. Next, as shown in FIG. 6(*c*), the user pulls the sheet P in the sheet discharge direction, so that the rear end thereof is dropped onto the outer tray 8. Then, as shown in FIG. 6(*d*), by pushing the sheet P into the main body 1, as in the case of feeding the sheet using the outer tray 8, the sheet P is fed directly into the main body 1.

As described, when switching the state of the machine from the discharge state to the sheet feed state, the sheet P may be displaced in the widthwise direction. However, the position in the widthwise direction of the sheets P is regulated by the sheet guide 8*c* shown in FIG. 4 or the guide ribs 8*d* shown in FIG. 5 to be placed within a predetermined range. Therefore, the sheet P is fed in the main body 1 without being displaced in the widthwise direction.

In the copying machine main body 1, the transporting direction of the sheet P is reversed by the transport guide 62 so that the next copy is made on the back surface. After a copy is made on the back surface of the sheet P, as shown in FIG. 6(*e*), the sheet P is discharged from the inner tray 7 to the outside of the main body 1. As described, "A" is copied to one surface of the sheet P, while "B" is copied to the back surface thereof.

As described, the copying machine in accordance with the present embodiment includes the inner tray 7 formed in the inside of the main body 1 and the outer tray 8 formed in the outside of the main body 1 at a different level from the inner tray 7. In this arrangement, the outer tray 8 guides the sheets to the transportation system 70 formed right below the inner tray 7, in the gap formed between the inner tray 7 and the outer tray 8, the opening Q for feeding sheets is formed as the outer tray 8 is positioned at a lower level than the inner tray 7. The opening Q for feeding sheets is formed as a gap between the inner tray 7 and the outer tray 8. The outer tray 8 is positioned at a lower level than the inner tray 7 at the gap.

In the described arrangement, the inner tray 7 and the outer tray 8 function as the discharge tray, while the outer tray 8 functions as the feed tray. Therefore, by displacing the sheet on the inner tray 7 in the sheet discharging direction to be moved onto the outer tray 8, the machine can be easily switched to the sheet feed state. This offers an easy handling of the sheet in the both-sided copy operation. Additionally, the structure where the inner tray 7 is formed in the inside of the main body 1 permits a shorter length of the outer tray 8 projected to the outside of the main body 1.

The copying machine in accordance with the present embodiment is arranged such that the transportation system 70 and the inner tray 7 are formed together on the feed cassette 71 which occupies a large portion in the copying machine. Additionally, the transportation system 70 is formed in a S-shape, and the transport roller 63 and the transport guide 66 lead to the opening Q formed in the gap between the inner tray 7 and the outer tray 8.

Compared with the arrangement where the feed cassette 71, the transportation system 70 and the inner tray 7 are placed two-dimensionally, the described arrangement of the preferred embodiment offers a smaller placement area required for the main body 1. Moreover, by adopting the S-shaped transportation system 70, the components can be easily arranged as described above. Furthermore, the transport roller 63 and the sheet transportation path on the downstream side of the transport guide 66 can be used in common when feeding the sheet from the feed cassette 71 and from the outer tray 8. As a result, the miniaturization of the main body 1 can be easily achieved.

[Embodiment 2]

Figure 7:
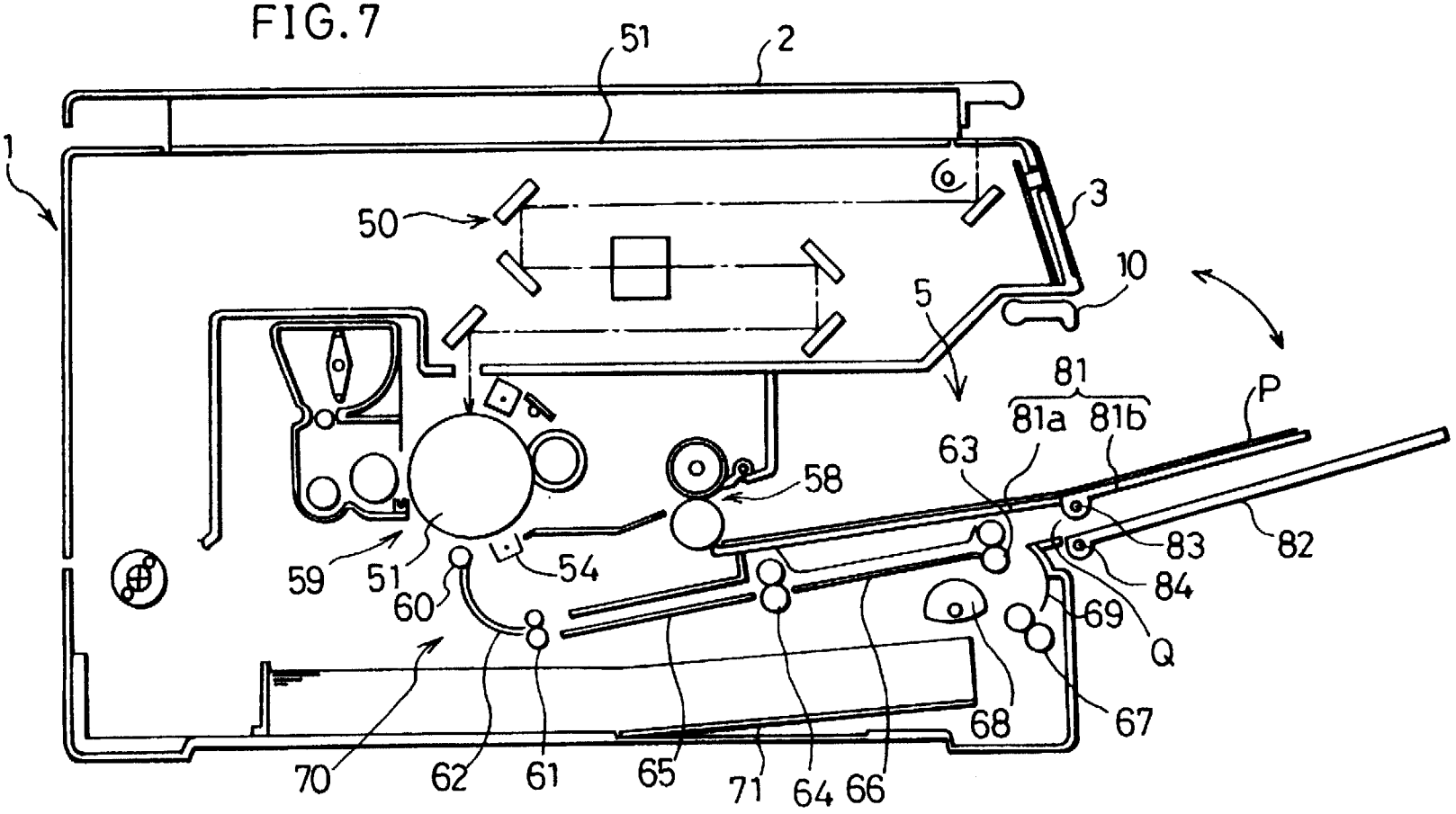
FIG. 7 is a longitudinal sectional view showing a schematic configuration of a copying machine in accordance with the second embodiment of the present invention.
Figure 8:
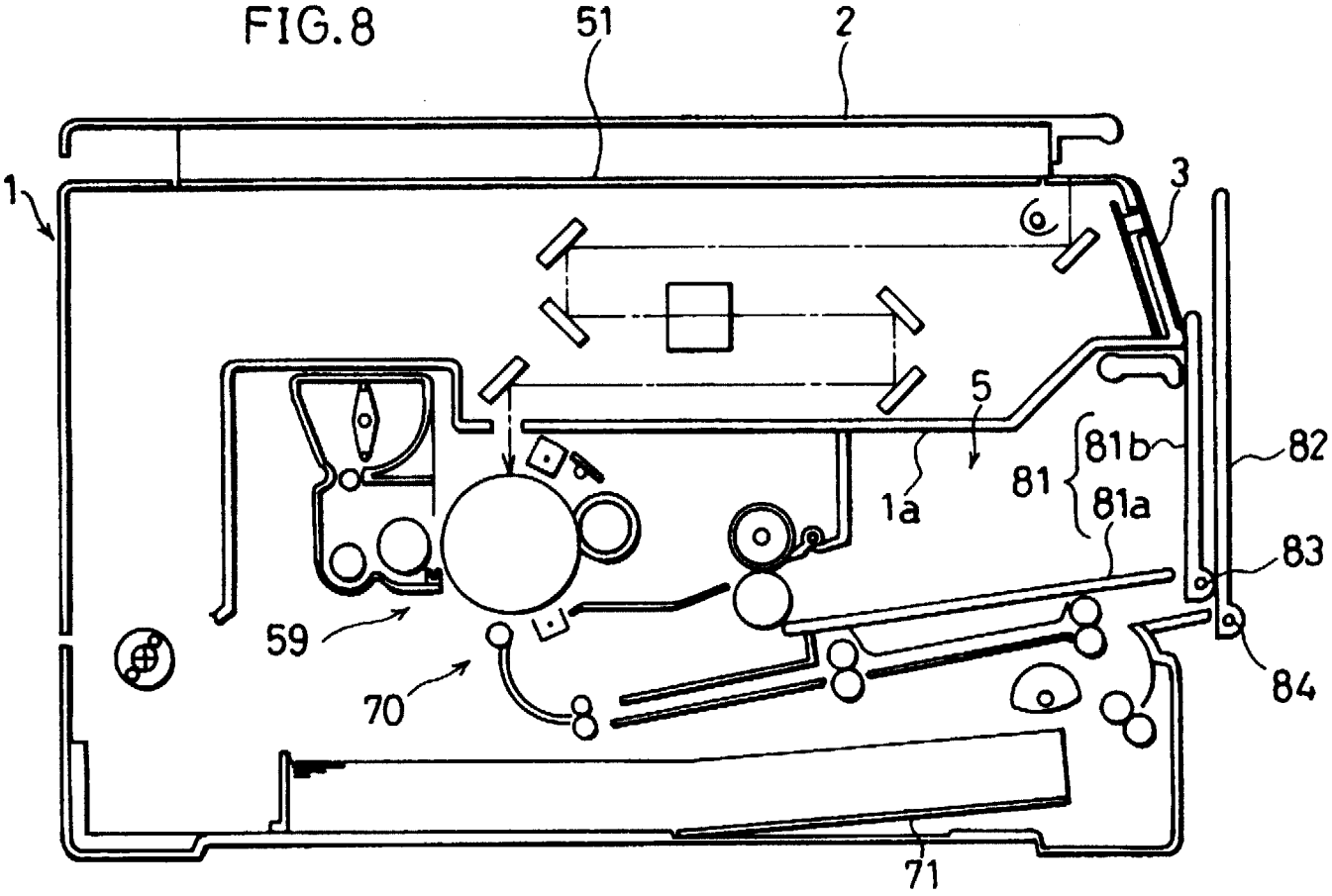
FIG. 8 is a longitudinal sectional view showing a state where a movable part of the upper tray and the lower tray close the sheet discharge section in the copying machine of FIG. 7.
Figure 9:
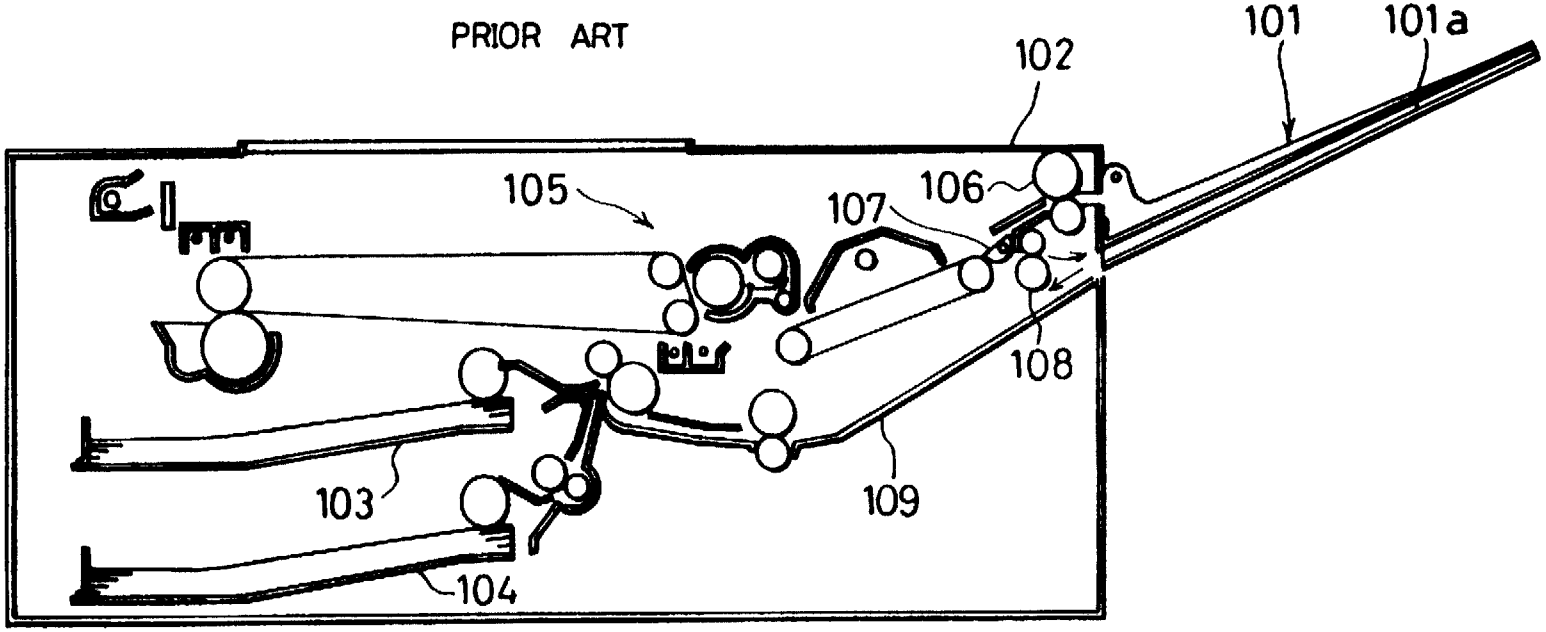
FIG. 9 PRIOR ART
FIG. 9 is a longitudinal sectional view showing a schematic configuration of a conventional copying machine.

The following descriptions will discuss the second embodiment of the present embodiment in reference to FIG. 7 and FIG. 8. For convenience in explanations, members having the same functions as those of the aforementioned embodiment will be designated by the same reference numerals, and thus the descriptions thereof shall be omitted here.

As shown in FIG. 7, a copying machine in accordance with the present embodiment is provided with an upper tray 81 as the first tray (tray) in replace of the inner tray 7 (see FIG. 1) in the copying machine of the first embodiment, and a lower tray 82 as the second tray in replace of the outer tray 8 of the first embodiment.

On the other hand, the upper tray 81 includes a fixed section 81*a* and a movable section 81*b*. The fixed section 81*a* is fixed to the inside of the main body 1, and the movable section 81*b* is projected to the outside of the main body 1. The fixed section 81*a* as an inner portion is formed to the length from a vicinity of the lower roller 58*b* to the opening of the sheet discharge section 5. The fixed section 81*a* is fixed at an inclined position substantially along the transport guide 66.

On the other hand, the movable section 81*b* as an outer portion is supported by a shaft 83 so as to be freely rotatable in a direction of an arrow with respect to the fixed section 81*a*. The rotatable range of the movable section 81*b* is regulated such that in its open position, the sheet placement surface is sloped upward at a slightly larger angle than the fixed section 81*a*. The movable section 81*b* is formed with a sufficient size for covering the opening of the sheet discharge section 5 completely.

The lower tray 82 is formed below the movable section 81*b* in a direction substantially parallel to the movable section 81*b*. The lower tray 82 is supported by a shaft 84 so as to be freely rotatable in a direction of an arrow with respect to the lower unit 1*c*. The rotatable range of the lower tray 82 is regulated such that in its open position, the sheet placement surface is sloped upward at a slightly larger angle than the transport guides 65 and 66, thereby enabling the lower tray 82 to guide sheets onto the transport guides 65 and 66. The lower tray 82 is projected to the outside of the main body 1 to a greater extent than the movable section 81*b*.

Between the upper tray 81 and the lower tray 82, the opening Q for feeding sheets is formed so as to lead to the transport roller 63 in a vicinity of the shafts 83 and 84.

In the copying machine having the described arrangement, the upper tray 81 includes the movable section 81*b* which is projected to the outside of the main body 1. Therefore, the copied sheet is received only by the upper tray 81. The lower tray 82 is projected to the outside of the main body 1 to a greater extent than the movable section 81*b*. Therefore, only by displacing the sheet on the upper tray 81 in the discharge direction to be moved onto the lower tray 82, the apparatus can be easily switched to the sheet feed state.

According to the copying machine of the described preferred embodiment, since the movable section 81*b* and the lower tray 82 are respectively supported by the shafts 83 and 84, the movable section 81*b* and the lower tray 82 can be opened and closed independently. Therefore, by setting the movable section 81*b* and the lower tray 82 respectively in the closed position and the opened position, the sheets can be easily fed from the lower tray 82 without being interfered by the movable section 81*b*. Here, in the case of adopting the sheet of a sufficiently small size, when the sheet is discharged onto the fixed section 81*a*, the sheet is not in contact with the movable section 81*b*. On the other hand, in the case of adopting the sheet of a substantially large size, the sheet can be fed from the lower tray 82 even in the opened position of the movable section 81*b* without problem.

As shown in FIG. 8, by closing the movable section 81*b* and the lower tray 82, the sheet discharge section 5 can be prevented from having foreign substances entered thereto. Moreover, when the copying machine is not used, the movable tray 81*b* and the lower tray 82 will not occupy the space uselessly.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A sheet feeding/discharging device designed for an image forming apparatus, comprising:

a first tray for receiving sheets discharged from the image forming apparatus; and a second tray for receiving the sheets discharged from said image forming apparatus, said second tray being projected in a sheet discharge direction to a greater extent than said first tray, said second tray being formed at a different level from said first tray, wherein an opening for feeding sheets in a main body of said image forming apparatus is formed as a gap between said first tray and said second tray said second tray being positioned at a lower level than said first tray at the gap, and the first and second trays are independently formed and are separated and distinct from each other.

2. The sheet feeding/discharging device as set forth in claim 1, wherein:

said main body includes a sheet discharge section formed so as to lead to an external section as a space for discharging sheets;

said first tray is formed in an inside of said sheet discharge section; and said second tray is mounted to said main body so as to be freely rotatable to open and close said sheet discharge section.

3. The sheet feeding/discharging device as set forth in claim 1, further comprising:

a regulating section provided on said second tray, for regulating a position of sheets in a widthwise direction.

4. The sheet feeding/discharging device as set forth in claim 3, wherein:

said regulating section is a recessed section formed to a predetermined width on said second tray.

5. The sheet feeding/discharging device as set forth in claim 3, wherein:

said regulating section is a pair of ribs formed on said second tray with a predetermined interval, said pair of ribs extending in a direction parallel to the discharge direction.

6. The sheet feeding/discharging device as set forth in claim 2, further comprising:

a power switch for turning OFF a power supply of said image forming apparatus when it is pressed by closing said second tray, and for turning ON the power supply of said image forming apparatus when it is separated from said second tray by opening the second tray.

7. The sheet feeding/discharging device as set forth in claim 1, wherein when a large sized discharge sheet is too large to be held only by the first tray, said large sized discharge sheet is held by both the first and second trays.

8. The sheet feeding/discharging device as set forth in claim 1, wherein the first tray is located inside the main body of said image forming apparatus, and said second tray is located outside the main body of said image forming apparatus.

9. A sheet feeding/discharging device as set forth in claim 1 wherein:

said first tray is further projected in the sheet discharge direction from the gap, whereby discharged sheets can be received only on said first tray.

10. A sheet feeding/discharging device designed for an image forming apparatus, comprising:

sheet storage means formed in an inside of a main body of said image forming apparatus, for feeding sheets for an image forming operation;

first reversal means for reversing a transporting direction of a sheet fetched from one end side of said sheet storage means;

transportation means for transporting the sheet in a reversed transporting direction by said first reversal means to an other end side of said sheet storage means;

second reversal means for reversing the transporting direction of the sheet transported by said transportation means;

a first tray for receiving the sheet transported in the reversed transporting direction by said second reversal means, said first tray being positioned above said transportation means; and a second tray for receiving the sheet discharged from said image forming apparatus, said second tray being projected in the sheet discharge direction to a greater extent than said first tray, said second tray being formed at a different level from said first tray, wherein an opening for feeding sheets in a main body of said image forming apparatus is formed as a gap between said first tray and said second tray said second tray being positioned at a lower level than said first tray at the gap, said opening leads to one end portion of said transportation means on a first reversal means side, and the first and second trays are independently formed and are separated and distinct from each other.

11. The sheet feeding/discharging device as set forth in claim 10, wherein:

said main body includes a sheet discharge section formed so as to lead to an external section as a space for discharging sheets;

said first tray is formed in an inside of said sheet discharge section; and said second tray is mounted to said main body so as to be freely rotatable to open and close said sheet discharge section.

12. The sheet feeding/discharging device as set forth in claim 10, further comprising:

a regulating section provided on said second tray, for regulating a position of sheets in a widthwise direction.

13. The sheet feeding/discharging device as set forth in claim 12, wherein:

said regulating section is a recessed section formed to a predetermined width on said second tray.

14. The sheet feeding/discharging device as set forth in claim 12, wherein:

said regulating section is a pair of ribs formed on said second tray with a predetermined interval, said pair of ribs extending in a direction parallel to the discharge direction.

15. The sheet feeding/discharging device as set forth in claim 10, wherein:

said first reversal means, said transportation means and said second reversal means constitute an S-shaped sheet transportation path.

16. The sheet feeding/discharging device as set forth in claim 10, wherein when a large sized discharge sheet is too large to be held only by the first tray, said large sized discharge sheet is held by both the first and second trays.

17. The sheet feeding/discharging device as set forth in claim 10, wherein the first tray is located inside the main body of said image forming apparatus, and said second tray is located outside the main body of said image forming apparatus.

18. A sheet feeding/discharging device as set forth in claim 10 wherein:

said first tray is further projected in the sheet discharge direction from the gap, whereby discharged sheets can be received only on said first tray.

19. The sheet feeding/discharging device as set forth in claim 11, further comprising:

a power switch for turning OFF a power supply of said image forming apparatus when it is pressed by closing said second tray, and for turning ON the power supply of said image forming apparatus when it is separated from said second tray by opening the second tray.

20. A sheet feeding/discharging device designed for an image forming apparatus, comprising:

sheet storage means formed in an inside of a main body of said image forming apparatus, for feeding sheets for an image forming operation, first reversal means for reversing a transporting direction of a sheet fetched from one end side of said sheet storage means;

transportation means for transporting the sheets in a reversed transporting direction by said first reversal means to an other end side of said sheet storage means, said transportation means being positioned above said sheet storage means and leading to an outside of the main body of said image forming apparatus at an end portion on the first reversal means;

second reversal means for reversing the transporting direction of the sheet transported by said transportation means; and a first tray, located inside a main body of the image forming apparatus, for receiving sheets transported in the reversed transporting direction by said second reversal means, said tray being formed above said transportation means, and an independent and distinct second tray located outside the main body of said image forming apparatus the second tray provided for storing sheets to be fed to the transportation means.

21. The sheet feeding/discharging device as set forth in claim 20, wherein:

said first reversal means, said transportation means and said second reversal means constitute an S-shaped sheet transportation path.

22. The sheet feeding/discharging device as set forth in claim 9, wherein:

said main body includes a sheets discharge section formed so as to lead to an external section as a space for discharging sheets, said first tray includes an inner portion formed in said sheet discharge section and an outer portion formed in an outside of said main body of said image forming apparatus, said outer portion being mounted to the inner portion so as to be freely rotatable to open and close said sheet discharge section, and said second tray being mounted to said main body of said image forming apparatus so as to be freely rotatable to open and close said sheet discharge section.

23. The sheet feeding/discharging device as set forth in claim 18, wherein:

said main body includes a sheet discharge section formed so as to lead to an external section as a space for discharging sheets, said first tray includes an inner portion formed in said sheet discharge section and an outer portion formed in an outside of said main body of said image forming apparatus, said outer portion being mounted to the inner portion so as to be freely rotatable to open and close said sheet discharge section, and said second tray being mounted to said main body of said image forming apparatus so as to be freely rotatable to open and close said sheet discharge section.

24. The sheet feeding/discharging device as set forth in claim 18, wherein:

said first reversal means, said transportation means and said second reversal means constitute an S-shaped sheet transportation path.

* * * * *